US010984974B2

(12) United States Patent
Mittelstadt, I

(10) Patent No.: US 10,984,974 B2
(45) Date of Patent: Apr. 20, 2021

(54) LINE SIDE POWER, DOUBLE BREAK, SWITCH NEUTRAL ELECTRONIC CIRCUIT BREAKER

(71) Applicant: SCHNEIDER ELECTRIC USA, INC., Andover, MA (US)

(72) Inventor: Chad Mittelstadt, I, Cedar Rapids, IA (US)

(73) Assignee: Schneider Electric USA, Inc., Andover, MA (US)

( * ) Notice: Subject to any disclaimer, the term of this patent is extended or adjusted under 35 U.S.C. 154(b) by 205 days.

(21) Appl. No.: 16/227,025

(22) Filed: Dec. 20, 2018

(65) Prior Publication Data

US 2020/0203108 A1 Jun. 25, 2020

(51) Int. Cl.

| | |
|---|---|
| ***H01H 73/12*** | (2006.01) |
| ***H01H 71/12*** | (2006.01) |
| ***H01H 71/02*** | (2006.01) |
| ***H01H 71/04*** | (2006.01) |

(52) U.S. Cl.
CPC ..... *H01H 71/12* (2013.01); *H01H 71/0207* (2013.01); *H01H 71/04* (2013.01)

(58) Field of Classification Search
CPC .... H01H 71/12; H01H 71/0207; H01H 71/04; H01H 23/00
USPC ..... 335/18
See application file for complete search history.

(56) References Cited

U.S. PATENT DOCUMENTS 2,618,716 A * 11/1952 Boller ..... H01H 71/52 335/6
3,421,123 A * 1/1969 Laubenheimer ..... H01H 71/40 335/35
3,464,040 A * 8/1969 Powell ..... H01H 71/524 335/191

(Continued)

FOREIGN PATENT DOCUMENTS

| | | | |
|---|---|---|---|
| EP | 0196241 | A1 | 10/1986 |
| EP | 1724803 | A2 | 11/2006 |
| EP | 3171385 | A1 | 5/2017 |

OTHER PUBLICATIONS

Extended European Search Report for related European Application No. 19213943.4-1202 dated Apr. 28, 2020.

*Primary Examiner* — Shawki S Ismail
*Assistant Examiner* — Lisa N Homza
(74) *Attorney, Agent, or Firm* — Locke Lord LLP

(57) ABSTRACT

A circuit breaker has a first stationary contact connected to line power and a second stationary contact connected to neutral. A first moveable contact coupled to a load power terminal, is mounted on a moveable actuator and juxtaposed with the first stationary contact to form a power circuit when the first moveable and first stationary contacts are closed. A second moveable contact connected to a load neutral terminal is mounted on the moveable actuator juxtaposed with the second stationary contact to form a neutral circuit when the second moveable and second stationary contacts are closed. The movable actuator moves the first and second moveable contacts in unison to open the power circuit between the first stationary and first moveable contacts and to simultaneously open the neutral circuit between the second stationary and second moveable contacts, in response to actuation of an operating handle or to sensing a tripping event.

5 Claims, 6 Drawing Sheets

(56) References Cited

U.S. PATENT DOCUMENTS 3,525,959 A * 8/1970 Ellsworth ..... H01H 71/501 335/166
3,745,414 A * 7/1973 Frantti ..... H02H 3/33 361/46
3,760,308 A * 9/1973 Misencik ..... H01H 71/1027 335/35
3,950,714 A * 4/1976 Mrenna ..... H01H 71/505 335/35
4,081,852 A * 3/1978 Coley ..... H01H 83/02 335/37
4,129,762 A * 12/1978 Bruchet ..... H01H 71/501 200/401
4,156,219 A * 5/1979 Coleman ..... H01H 71/40 335/175
4,164,719 A * 8/1979 Young ..... H01H 89/06 335/14
4,232,282 A * 11/1980 Menocal ..... H01H 71/0214 335/202
4,263,492 A * 4/1981 Maier ..... H01H 71/504 200/288
4,368,444 A * 1/1983 Preuss ..... H01H 71/501 335/166
4,472,696 A * 9/1984 Bellows ..... H01H 71/40 335/23
4,513,268 A * 4/1985 Seymour ..... H01H 71/0214 335/191
4,546,224 A * 10/1985 Mostosi ..... H01H 71/501 200/401
4,594,491 A * 6/1986 Leone ..... H01H 71/505 200/325
4,604,596 A * 8/1986 Yokoyama ..... H01H 89/10 335/14
4,609,898 A * 9/1986 Seymour ..... H01H 71/0214 174/50
4,616,200 A * 10/1986 Fixemer ..... H01H 71/524 335/35
4,623,859 A * 11/1986 Erickson ..... H01H 3/38 335/14
4,630,019 A * 12/1986 Maier ..... H01H 71/7436 337/70
4,686,600 A * 8/1987 Morris ..... H01H 83/04 29/622
4,713,639 A * 12/1987 Grunert ..... H01H 71/128 335/172
4,969,063 A 11/1990 Scott et al.
5,151,671 A * 9/1992 Hirao ..... H01H 71/524 335/167
5,165,532 A * 11/1992 Pipich ..... H01H 71/501 200/327
5,196,815 A * 3/1993 Chien ..... H01H 71/121 335/16
5,213,206 A * 5/1993 Beck ..... H01H 71/501 200/327
5,245,302 A * 9/1993 Brune ..... H01H 71/405 335/23
5,245,305 A * 9/1993 Ricker ..... H01H 9/00 200/293
5,250,918 A * 10/1993 Edds ..... H01H 9/342 335/21
5,296,664 A * 3/1994 Crookston ..... H01H 71/501 200/401
5,301,083 A * 4/1994 Grass ..... H01H 89/06 361/64
5,302,787 A * 4/1994 Edds ..... H01H 71/0214 200/244
5,331,301 A * 7/1994 Glennon ..... H01H 83/20 335/14
5,373,411 A * 12/1994 Grass ..... H01H 89/06 361/64
5,449,871 A * 9/1995 Batteux ..... H01H 71/501 200/401
5,483,211 A * 1/1996 Carrodus ..... H01H 71/0207 335/18
5,510,759 A * 4/1996 Gula ..... H01H 83/226 335/18
5,546,060 A * 8/1996 Mrenna ..... H01H 71/0214 335/202
5,581,063 A * 12/1996 Clark ..... H01H 9/34 218/146
5,608,198 A * 3/1997 Clark ..... H01H 9/302 218/147
5,706,154 A * 1/1998 Seymour ..... H01H 71/36 335/201
5,805,038 A * 9/1998 Palmer ..... H01H 71/504 335/176
5,818,671 A * 10/1998 Seymour ..... H02H 1/0015 361/42
5,821,839 A * 10/1998 Heise ..... H01H 71/7436 335/35
5,831,498 A * 11/1998 Maloney ..... H01H 9/0264 335/8
5,831,500 A * 11/1998 Turner ..... H01H 71/04 335/17
5,831,509 A * 11/1998 Elms ..... H01H 71/125 337/333
5,834,997 A * 11/1998 Fleege ..... H01H 71/70 335/68
5,844,188 A * 12/1998 Cella ..... H01H 71/525 218/22
5,847,630 A * 12/1998 Arnold ..... H01H 9/342 335/35
5,859,578 A * 1/1999 Arnold ..... H01H 9/465 337/110
5,861,784 A * 1/1999 Heise ..... H01H 83/20 200/400
5,866,996 A * 2/1999 Navarre ..... H01H 77/102 218/22
5,872,495 A * 2/1999 DiMarco ..... H01H 71/164 335/22
5,886,600 A * 3/1999 Larranaga ..... H01H 71/405 335/35
5,894,260 A * 4/1999 Cella ..... H01H 71/16 337/3
5,933,306 A * 8/1999 Santos ..... H01H 71/08 361/102
6,037,555 A * 3/2000 Castonguay ..... H01H 1/2058 200/306
6,072,136 A * 6/2000 Wehrli, III ..... H01H 3/60 200/401
6,087,913 A * 7/2000 Castonguay ..... H01H 71/525 200/400
6,087,914 A * 7/2000 Kralik ..... H01H 71/7418 335/172
6,104,265 A * 8/2000 Maloney ..... H01H 71/462 200/308
6,114,641 A * 9/2000 Castonguay ..... H01H 1/205 200/17 R
6,166,344 A * 12/2000 Castonguay ..... H01H 71/501 200/325
6,184,761 B1 * 2/2001 Doma ..... H01H 1/2041 218/22
6,188,036 B1 * 2/2001 Arnold ..... H01H 1/2058 218/157
6,204,743 B1 * 3/2001 Greenberg ..... H01H 1/2058 218/22
6,222,143 B1 * 4/2001 Lawson ..... H01H 71/501 200/401
6,225,883 B1 * 5/2001 Wellner ..... H01H 71/505 200/400
6,232,570 B1 * 5/2001 Castonguay ..... H01H 1/2041 218/146
6,232,856 B1 * 5/2001 Boucher ..... H01H 1/2058 218/22
6,232,860 B1 * 5/2001 Acevedo ..... H01H 71/505 335/167
6,239,676 B1 * 5/2001 Maloney ..... H01H 71/7436 335/35

(56) References Cited

U.S. PATENT DOCUMENTS 6,239,677 B1 * 5/2001 Ramakrishnan ..... H01H 1/2058 335/172
6,259,339 B1 * 7/2001 Simms ..... H01H 89/06 335/14
6,259,340 B1 * 7/2001 Fuhr ..... H01H 71/128 335/18
6,281,458 B1 * 8/2001 Castonguay ..... H01H 1/2058 218/22
6,307,453 B1 * 10/2001 Wellner ..... H01H 83/20 335/172
6,310,307 B1 * 10/2001 Ciarcia ..... H01H 1/205 200/17 R
6,317,018 B1 * 11/2001 Castonguay ..... H01H 71/1009 335/10
6,326,868 B1 * 12/2001 Kranz ..... H01H 1/205 218/22
6,340,925 B1 * 1/2002 Castonguay ..... H01H 1/2058 335/167
6,346,868 B1 * 2/2002 Castonguay ..... H01H 1/2058 335/167
6,362,711 B1 * 3/2002 Larranaga ..... H01H 71/7427 335/17
6,366,438 B1 * 4/2002 Bauer ..... H01H 1/205 335/16
6,380,829 B1 * 4/2002 Castonguay ..... H01H 1/2058 335/172
6,388,858 B1 * 5/2002 Simms ..... H01H 89/06 335/14
6,396,369 B1 * 5/2002 Schlitz ..... H01H 1/205 218/22
6,400,245 B1 * 6/2002 Castonguay ..... H01H 1/2058 200/50.05
6,429,759 B1 * 8/2002 Schlitz ..... H01H 1/06 200/275
6,429,760 B1 * 8/2002 Greenberg ..... H01H 71/08 200/293
6,448,521 B1 * 9/2002 Castonguay ..... H01H 71/525 200/318
6,448,522 B1 * 9/2002 Rosen ..... H01H 1/2058 200/322
6,459,059 B1 * 10/2002 Greenberg ..... H01H 1/2058 200/401
6,469,600 B1 * 10/2002 Seese ..... H01H 89/06 335/13
6,476,337 B2 * 11/2002 Castonguay ..... H01H 1/2058 200/330
6,477,022 B1 * 11/2002 Ennis ..... H01H 89/06 335/18
6,479,774 B1 * 11/2002 Castonguay ..... H01H 1/2058 200/244
6,483,408 B1 * 11/2002 Mrenna ..... H01H 71/121 335/201
6,486,759 B2 * 11/2002 Haugh ..... H01H 71/7436 335/176
6,489,867 B1 * 12/2002 Turner ..... H01H 1/5822 335/35
6,507,256 B1 * 1/2003 Castonguay ..... H01H 71/2472 218/22
6,531,941 B1 * 3/2003 Greenberg ..... H01H 71/08 200/293
6,614,334 B1 * 9/2003 Gibson ..... H01H 71/1045 335/132
6,667,680 B1 * 12/2003 Gibson ..... H01H 71/501 335/167
6,714,108 B1 * 3/2004 Simms ..... H01H 3/001 200/240
6,724,284 B2 * 4/2004 Simms ..... H01H 71/46 335/14
6,759,931 B1 * 7/2004 Lias ..... H01H 71/505 335/167
6,800,823 B1 * 10/2004 Malingowski ..... H01H 71/528 200/244
6,800,824 B1 * 10/2004 Slepian ..... H01H 71/528 200/244
6,801,110 B2 * 10/2004 Kolberg ..... H01H 1/5822 335/172
6,803,535 B1 * 10/2004 Whipple ..... H01H 71/04 200/308
6,803,536 B1 * 10/2004 Slepian ..... H01H 71/528 200/244
6,861,930 B2 * 3/2005 Simms ..... H01H 71/46 335/14
6,870,115 B1 * 3/2005 Slepian ..... H01H 71/528 200/303
7,019,606 B2 * 3/2006 Williams ..... H01H 89/08 335/20
7,061,349 B2 * 6/2006 Castonguay ..... H01H 89/08 335/14
7,187,258 B2 * 3/2007 Yamazaki ..... H01H 9/30 200/305
7,342,474 B2 * 3/2008 Castonguay ..... H01H 89/08 200/400
7,800,478 B2 * 9/2010 Puhalla ..... H01H 71/40 337/107
7,843,290 B2 * 11/2010 Song ..... H01H 71/501 335/6
8,058,580 B2 * 11/2011 Gottschalk ..... H01H 3/3015 200/400
8,089,282 B2 * 1/2012 Zende ..... H01H 83/04 324/424
8,169,757 B2 * 5/2012 Larson ..... H01H 71/04 361/42
8,243,411 B2 * 8/2012 Larson ..... H01H 9/16 361/115
8,471,655 B2 * 6/2013 Woodson ..... H01H 77/02 335/26
8,698,024 B2 * 4/2014 Woodson ..... H01H 71/0271 200/332
8,735,758 B2 * 5/2014 Chen ..... H01H 73/18 218/154
8,735,759 B2 * 5/2014 Potratz ..... H01H 9/342 218/155
8,749,329 B2 * 6/2014 Fasano ..... H01H 71/2409 335/39
8,766,749 B2 * 7/2014 Ganley ..... H01H 71/70 335/173
8,971,055 B2 * 3/2015 Gass ..... H05K 3/4691 361/781
9,171,684 B2 * 10/2015 Bunk ..... H01H 71/525
9,502,200 B1 * 11/2016 Fleege ..... H01H 71/405
9,564,280 B2 * 2/2017 Mittlestadt ..... H01H 71/126
9,865,415 B2 * 1/2018 Mittelstadt ..... H01H 21/22
10,002,736 B2 * 6/2018 Woodson ..... H01H 1/50
10,020,152 B2 * 7/2018 Pearson ..... H01H 71/10
10,326,264 B1 * 6/2019 Gass ..... G01R 31/3278
10,837,815 B2 * 11/2020 Henry ..... G01F 1/8436
2002/0046940 A1 4/2002 Bruckert et al.
2002/0075123 A1 * 6/2002 Lias ..... H01H 71/48 337/36
2002/0158725 A1 * 10/2002 Nerstrom ..... H01H 73/14 335/17
2002/0158726 A1 * 10/2002 Wellner ..... H01H 73/56 335/18
2003/0038692 A1 * 2/2003 Schmalz ..... H02H 1/06 335/35
2003/0193381 A1 * 10/2003 Davidson ..... H01H 89/06 335/14
2004/0149556 A1 * 8/2004 Lias ..... H01H 71/524 200/400
2004/0150495 A1 * 8/2004 Lias ..... H01H 71/505 335/2
2004/0150496 A1 * 8/2004 Lias ..... H01H 71/0221 335/2
2004/0150497 A1 * 8/2004 Lias ..... H01H 71/10 335/21
2004/0196123 A1 * 10/2004 Simms ..... H01H 89/06 335/6

(56) References Cited

U.S. PATENT DOCUMENTS

2004/0257183 A1* 12/2004 Fello ..... H01H 71/524 335/172
2005/0046525 A1* 3/2005 Tongo ..... H01H 73/14 335/17
2005/0046526 A1* 3/2005 Lipsey, II ..... H01H 73/14 335/17
2005/0269195 A1* 12/2005 Brandon ..... H01H 71/524 200/400
2007/0034495 A1* 2/2007 Christmann ..... H01H 71/526 200/400
2007/0046403 A1* 3/2007 Christmann ..... H01H 71/526 335/35
2007/0085643 A1* 4/2007 Gula ..... H01H 71/525 335/172
2007/0215577 A1* 9/2007 Park ..... H01H 71/501 218/150
2008/0084266 A1* 4/2008 Fleege ..... H01H 71/16 337/72
2008/0094155 A1* 4/2008 Fleege ..... H01H 71/7418 335/6
2010/0156576 A1* 6/2010 Broghammer ..... H01H 83/20 335/35
2011/0115585 A1* 5/2011 Fleege ..... H01H 83/226 335/10
2011/0205005 A1* 8/2011 Navarre ..... H01H 71/524 335/205
2012/0132506 A1* 5/2012 Potratz ..... H01H 9/20 200/43.11
2012/0325632 A1* 12/2012 Mittelstadt ..... H01H 71/504 200/273
2013/0001201 A1* 1/2013 Mittelstadt ..... H01H 9/46 218/148
2014/0158508 A1* 6/2014 Mittelstadt ..... H01H 1/50 200/284
2014/0176293 A1* 6/2014 Melecio ..... H01H 71/18 337/12
2014/0312996 A1* 10/2014 Maloney ..... H01H 71/405 335/38
2016/0005555 A1* 1/2016 Najera ..... H01H 71/04 335/18
2016/0049263 A1* 2/2016 Maloney ..... H01H 3/04 335/21
2016/0049274 A1* 2/2016 Maloney ..... H01H 71/025 335/21
2016/0163488 A1* 6/2016 Maloney ..... H01H 9/38 335/15
2016/0181045 A1* 6/2016 Gates ..... H01H 71/1027 200/330
2017/0194123 A1* 7/2017 Tetik ..... H01H 71/04
2017/0338072 A1* 11/2017 Hiremath ..... H01H 71/025
2018/0261417 A1* 9/2018 Woo ..... H01H 71/405
2019/0052072 A1* 2/2019 Gass ..... H02H 1/0015

* cited by examiner

LINE SIDE POWER, DOUBLE BREAK, SWITCH NEUTRAL ELECTRONIC CIRCUIT BREAKER

FIELD OF THE INVENTION

The invention disclosed relates to circuit breakers.

BACKGROUND

Miniature circuit breakers are well known in the prior art. An illustrative circuit breaker design is disclosed in U.S. Pat. No. 5,245,302, which is assigned to the same assignee as the present application, and the disclosure in which is incorporated herein by reference. As illustrated in the '302 patent, the basic miniature automatic circuit breaker comprises a base and cover, a line power terminal, a load power terminal, and an electrical circuit between the line terminal and a load terminal. The electrical circuit includes a stationary contact and a movable contact secured to a contact carrier, which is movable between a contact OPEN position and a contact CLOSED position to open or close the electrical circuit. The circuit breaker includes an arc interrupting chamber, an operating mechanism for opening and closing the contacts, and a current responsive trip mechanism, which releases the operating mechanism to open the contacts in response to a sustained moderate overload or an instantaneous short circuit.

Modern miniature circuit breakers incorporate light emitting diodes (LEDs) to enable users to easily identify the trip condition and type of fault, for example an arc fault or ground fault. In some embodiments, the circuit for the LEDs is powered from the line power side, to ensure that the LEDs remain lit when the circuit breaker is tripped. However, an electrical shock hazard may occur if the neutral terminal of the circuit breaker is inadvertently disconnected, causing power from the line power side to flow through the circuit for the LEDs and be present on the load neutral terminal of the circuit breaker.

SUMMARY

By contrast, the invention provides a simple, safe, practical and easily manufactured miniature circuit breaker, which provides power from the line power side to the electronics board or printed circuit board assembly (PCBA), while preventing an electrical shock hazard if the neutral terminal of the circuit breaker is inadvertently disconnected. The PCBA may provide power to LEDS or power other functions, such as denial of service solenoids or internal communications hardware, such as radio transmitters and receivers. In accordance with the invention, the circuit breaker includes separate contact pairs for the line power terminal to load power terminal circuit path and for the neutral terminal to load neutral terminal circuit path, and both contact pairs are simultaneously opened and closed in unison. The PCBA is directly connected across the line power terminal and the neutral terminal and remains connected when both pairs of contacts are opened. However, when both pairs of contacts are opened, both line power and neutral circuit paths are interrupted from connection to the load power and load neutral terminals, to prevent power from the line power side to flow through the circuit for the PCBA and be present on the load neutral terminal of the circuit breaker.

DESCRIPTION OF EMBODIMENTS OF THE INVENTION

Figure 1A:
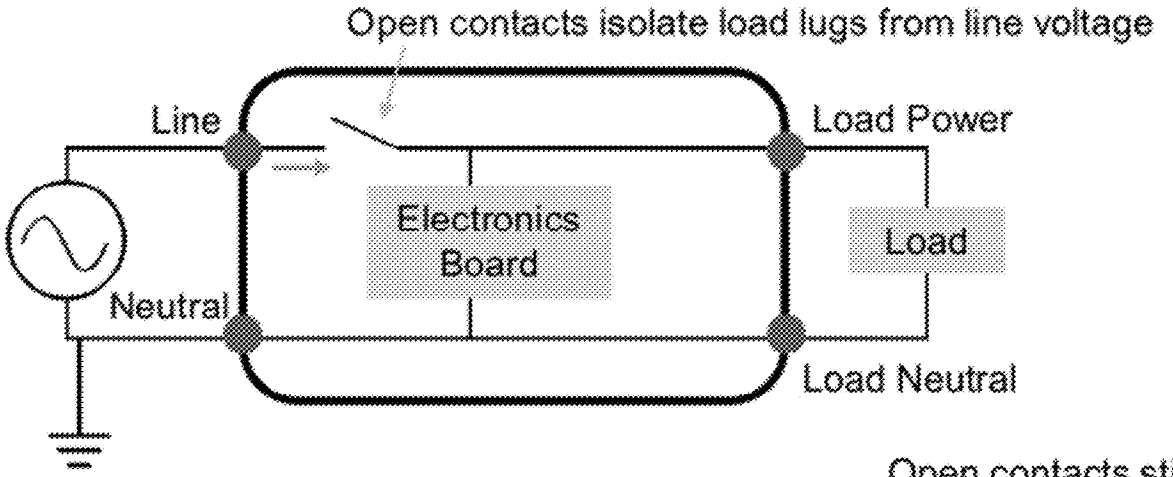
FIGS. 1A and 1B are circuit diagrams of a prior art circuit breaker, showing a miniature circuit breaker that incorporates an electronics board powered from the load side, but power to the LEDs is interrupted when the breaker contacts are opened.
Figure 1B:
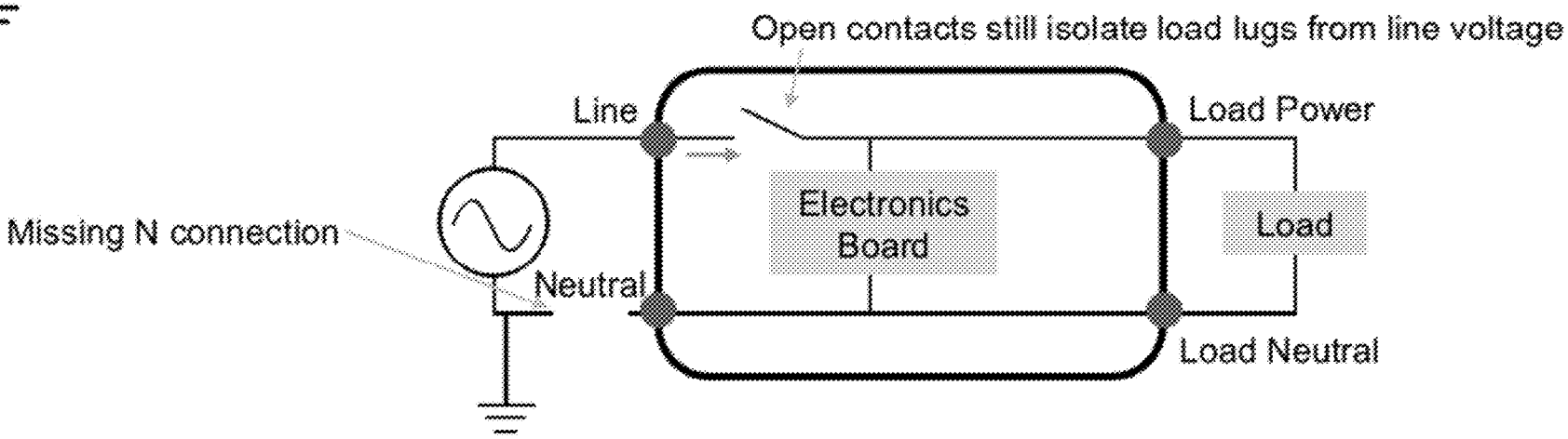

FIGS. 1A and 1B are circuit diagrams of a prior art circuit breaker that incorporates an electronics board that includes light emitting diodes (LEDs) to enable users to easily identify the trip condition and type of fault, for example an arc fault or ground fault. The circuit for the electronics board is powered from the load side, but power to the electronics board is interrupted when the breaker contacts are opened.

Figure 2A:
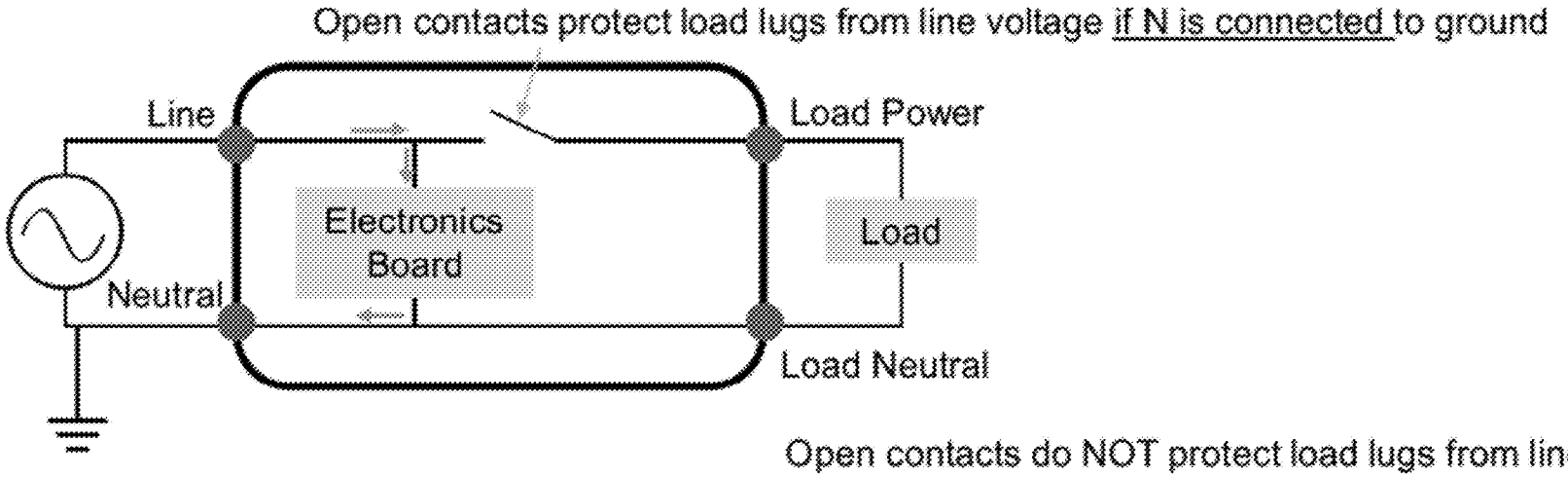
FIGS. 2A and 2B are circuit diagrams of a prior art circuit breaker, showing a miniature circuit breaker that incorporates an electronics board powered from the line power side, but an electrical shock hazard may occur if the neutral terminal of the circuit breaker is inadvertently disconnected, causing power from the line power side to flow through the circuit for the electronics board and be present on the load neutral terminal of the circuit breaker.
Figure 2B:
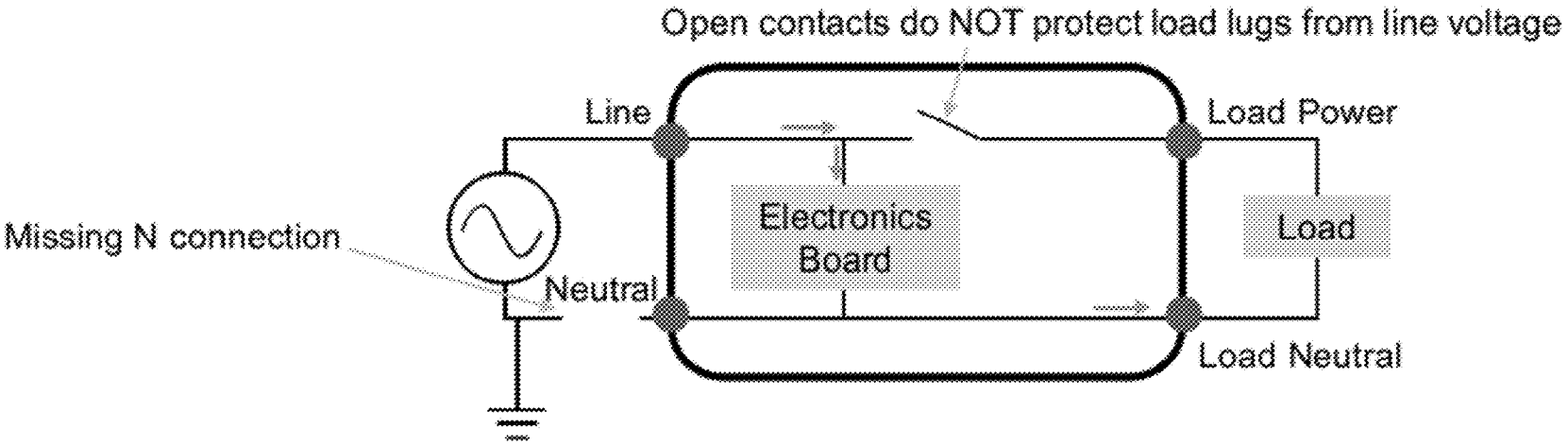

FIGS. 2A and 2B are circuit diagrams of a prior art circuit breaker, showing a miniature circuit breaker that incorporates an electronics board that includes light emitting diodes (LEDs) powered from the line power side to ensure that the LEDs remain lit when the circuit breaker is tripped. However, an electrical shock hazard may occur if the neutral terminal of the circuit breaker is inadvertently disconnected, causing power from the line power side to flow through the circuit for the electronics board and be present on the load neutral terminal of the circuit breaker.

Figures 3A, 3B:
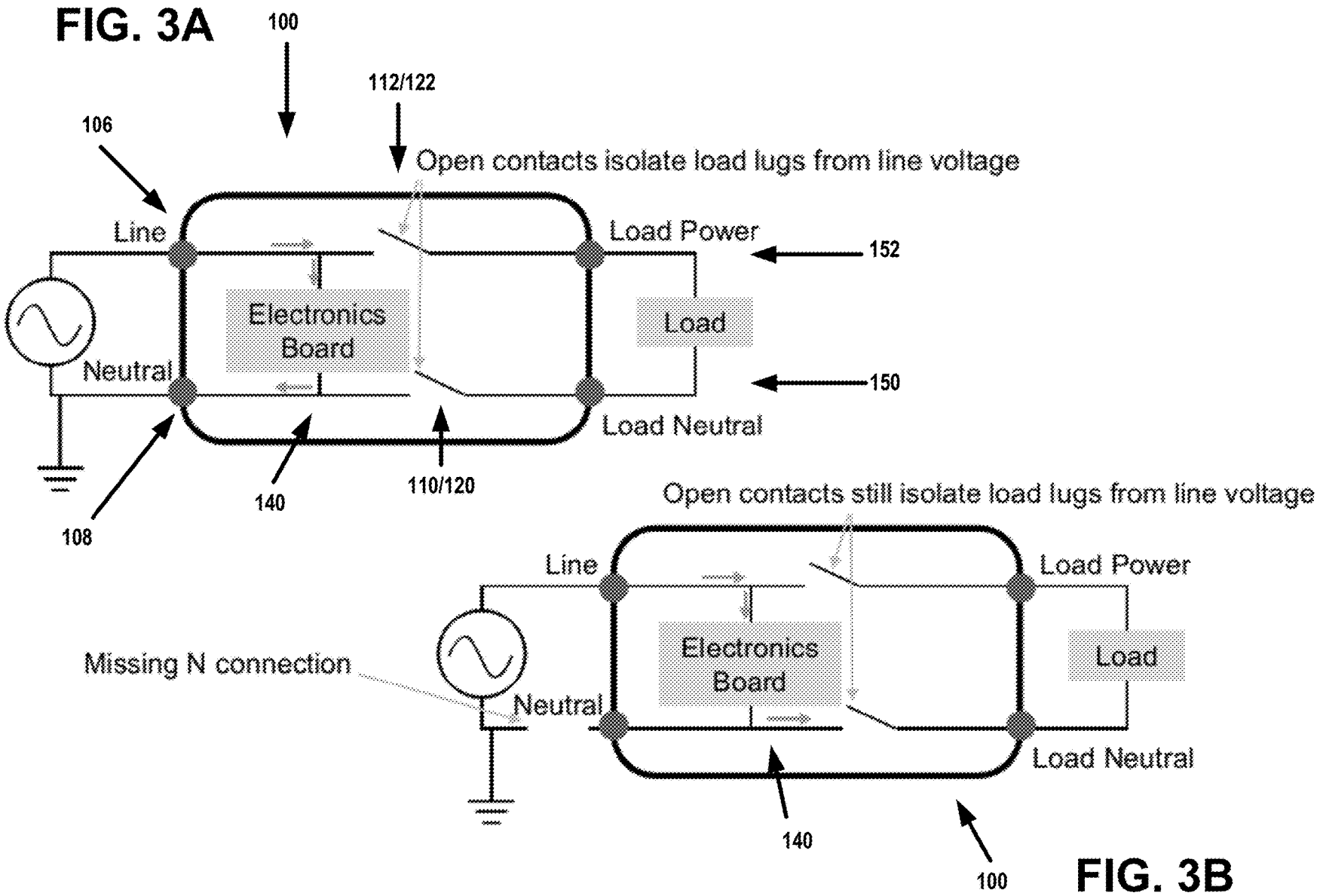
FIGS. 3A and 3B are circuit diagrams of a circuit breaker in accordance with the invention, showing a miniature circuit breaker that incorporates an electronics board powered from the line power side. Power is provided from the line power side to the electronics board, while preventing an electrical shock hazard if the neutral terminal of the circuit breaker is inadvertently disconnected. The circuit breaker includes separate contact pairs for the line power terminal to load power terminal circuit path and for the neutral terminal to load neutral terminal circuit path, and both contact pairs are simultaneously opened and closed in unison. When both pairs of contacts are opened, both line power and neutral circuit paths are interrupted from connection to the load power and load neutral terminals, to prevent power from the line power side to flow through the circuit for the electronics board and be present on the load neutral terminal of the circuit breaker.

FIGS. 3A and 3B are circuit diagrams of a circuit breaker 100 in accordance with the invention, showing a miniature circuit breaker that incorporates an electronics board or printed circuit board assembly (PCBA) 140 powered from the line power side 106. The PCBA 140 may provide power to LEDS or power other functions, such as denial of service solenoids or internal communications hardware, such as radio transmitters and receivers. Power is provided from the line power side to the PCBA, while preventing an electrical shock hazard if the neutral terminal 108 of the circuit breaker is inadvertently disconnected. The circuit breaker includes separate contact pairs 112/122 for the line power terminal 106 to load power terminal 152 circuit path and contact pairs 110/120 for the neutral terminal 108 to load neutral terminal 150 circuit path, and both contact pairs are simultaneously opened and closed in unison. When both pairs of contacts 110/120 and 112/122 are opened, both line power circuit path 106/152 and neutral circuit path 108/150 are interrupted from connection to the load power 152 and load neutral 150 terminals, to prevent power from the line power side 106 to flow through the circuit board 140 and be present on the load neutral terminal 150 of the circuit breaker.

Figure 4A:
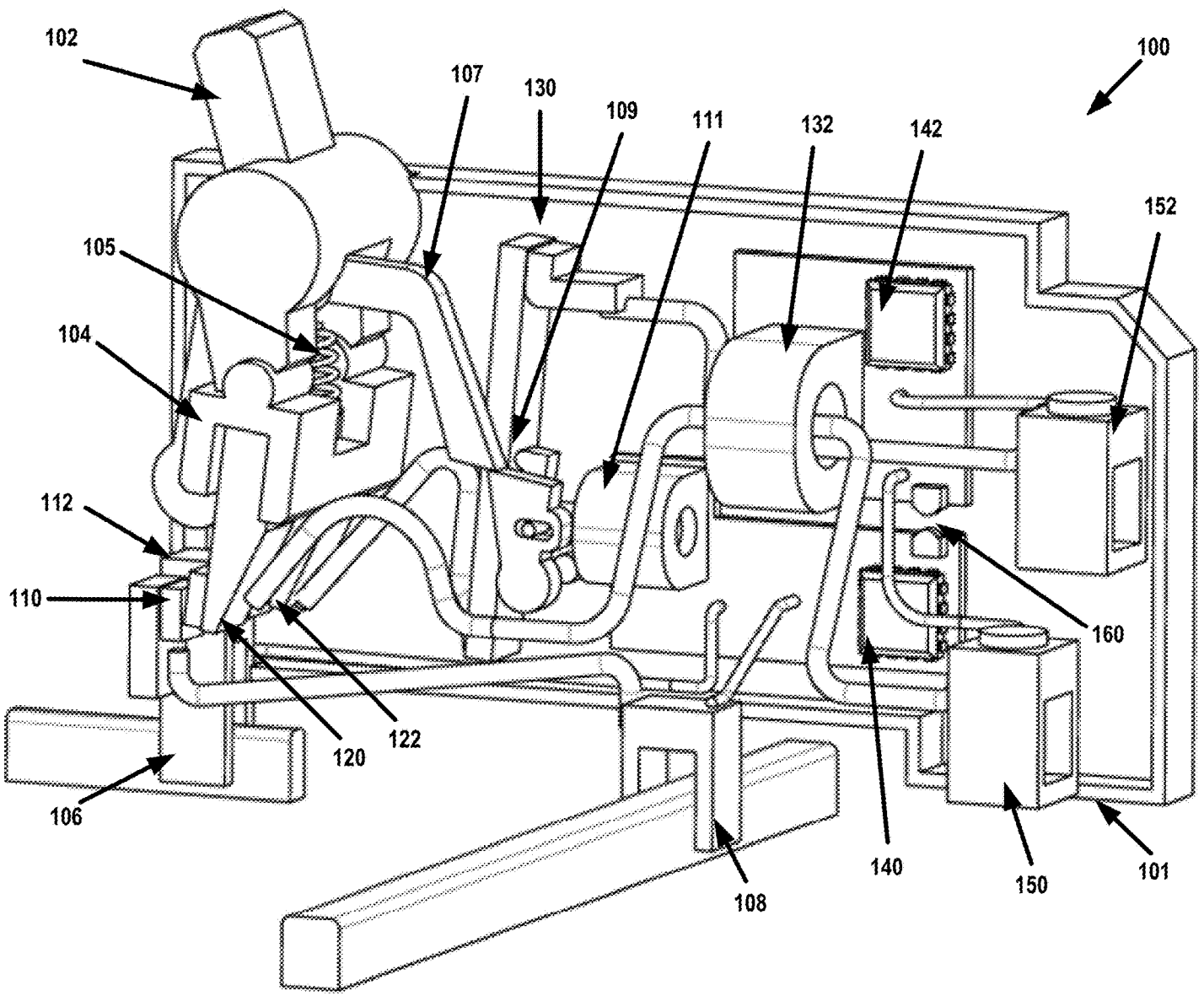
FIG. 4A is a front perspective view from the top left side of the circuit breaker of FIGS. 3A and 3B, in the contact pairs CLOSED or in the ON position, in accordance with the invention. The circuit breaker includes separate contact pairs for the line power terminal to load power terminal circuit path and for the neutral terminal to load neutral terminal circuit path, and both contact pairs are simultaneously opened and closed in unison. The circuit for the electronics board is directly connected across the line power terminal and the neutral terminal and remains connected when both pairs of contacts are opened. However, when both pairs of contacts are opened, both line power and neutral circuit paths are interrupted from connection to the load power and load neutral terminals, to prevent power from the line power side to flow through the circuit for the electronics board and be present on the load neutral terminal of the circuit breaker, in accordance with the invention.

FIG. 4A is a front perspective view from the top left side of the circuit breaker of FIGS. 3A and 3B, with the contact pairs 110/120 and 112/122 CLOSED or in the ON position, in accordance with the invention. The circuit breaker 100 includes a housing 101 of the circuit breaker, including an operating handle 102 and an overcurrent tripping mechanism 130.

The circuit breaker 100 includes a first stationary contact 112 in the housing, connected to a line power terminal 106 of the circuit breaker.

The circuit breaker 100 includes a second stationary contact 110 in the housing, connected to a neutral terminal 108 of the circuit breaker.

The circuit breaker 100 includes a first moveable contact 122 in the housing, coupled to a load power terminal 152 of the circuit breaker, the first moveable contact 122 mounted on a moveable actuator 104 and juxtaposed with the first stationary contact 112 to form a power circuit between the line power terminal 106 and the load power terminal 152 when the first moveable 122 and first stationary contacts 112 are closed.

The circuit breaker 100 includes a second moveable contact 120 in the housing, connected to a load neutral terminal 150 of the circuit breaker, the second moveable contact 120 mounted on the moveable actuator 104 juxtaposed with the second stationary contact 110 to form a neutral circuit between the neutral terminal 108 and the load neutral terminal 150 when the second moveable 120 and second stationary 110 contacts are closed.

Figure 4B:
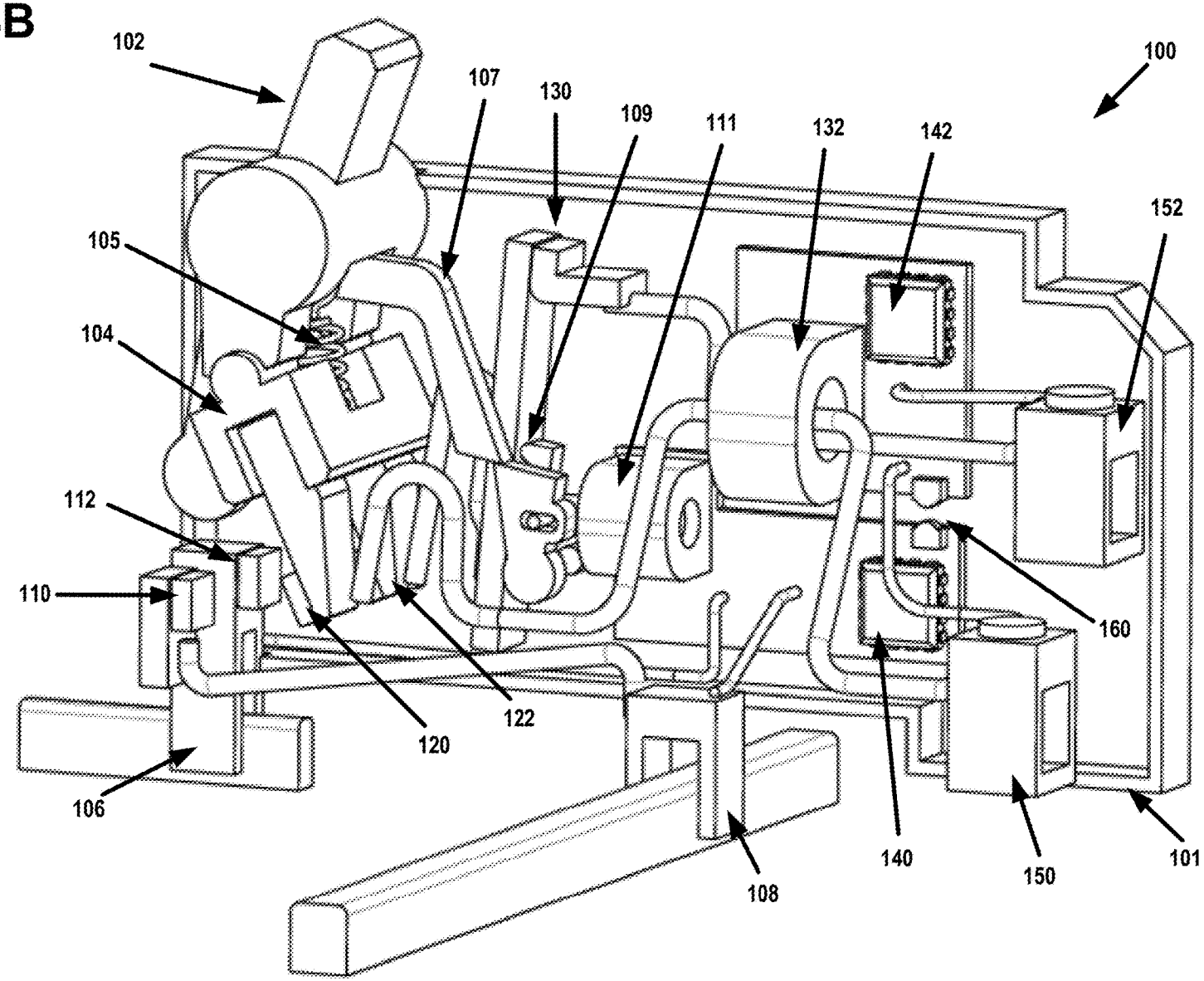
FIG. 4B is a front perspective view from the top left side of the circuit breaker of FIGS. 3A and 3B, in the contact pairs OPEN or in the OFF position, in accordance with the invention.

The movable actuator 104 is configured to move the first 122 and second 120 moveable contacts in unison to open the power circuit between the respective first stationary 112 and first moveable contacts 122 and simultaneously to open the neutral circuit between the second stationary 110 and second moveable 120 contacts, in response to an actuation of the operating handle 102 or to the overcurrent tripping mechanism 130 sensing a tripping event, as shown in FIG. 4B. The overcurrent tripping mechanism 130 includes a firing or trip solenoid 111 that releases a trip latch 109 that moves a trip lever 107 that toggles the moveable actuator 104 to open both pairs of contacts 110/120 and 112/122 when an overcurrent condition is detected. The movable actuator 104 toggles between the CLOSED position in FIG. 4A and the OPEN position in FIG. 4B with the toggle spring 105. The movable actuator 104 also provides an electrical isolation barrier between the first and second moveable contacts 120 and 122.

The circuit breaker 100 includes a load-powered circuit board 142 that writes the fault type of the tripping event, via the opto-coupler 160, to the line-powered circuit board 140, at the same time as the firing or trip solenoid 111 releases the trip latch 109 that moves the trip lever 107 to open both pairs of contacts 110/120 and 112/122. The LEDs in the line-powered circuit board 140 then display the type of fault. The circuit board 140 may also host communication hardware, such as radio transmitters and receivers to communicate the tripped state of the contacts. The circuit board 140 may also host denial of service hardware, such as circuits and solenoids to move the moveable actuator 104, to turn the circuit breaker on and off, for example in response to commands received by the radio receiver.

The circuit breaker 100 includes a reduced size arc chamber 115 (shown in FIG. 4C) in the housing 101 surrounding the first and second stationary contacts 110/112 and the first and second moveable contacts 120/122, corresponding to a reduced size air gap between the first moveable contact and first stationary contact and a reduced size air gap between the second moveable contact and the second stationary contact. The reduced size air gaps are based on dividing in half, an arc current flowing between the first and second stationary contacts and the first and second moveable contacts.

FIG. 4B is a front perspective view from the top left side of the circuit breaker of FIGS. 3A and 3B, with the contact pairs 110/120 and 112/122 OPEN or in the OFF position, in accordance with the invention. The operating handle 102 is shown in an OFF position and the contact pairs opened. The movable actuator 104 is configured to move the first 122 and second 120 moveable contacts in unison to open the power circuit between the respective first stationary 112 and first moveable contacts 122 and simultaneously to open the neutral circuit between the second stationary 110 and second moveable 120 contacts, in response to an actuation of the operating handle 102 or to the overcurrent tripping mechanism 130 sensing a tripping event.

Figure 4C:
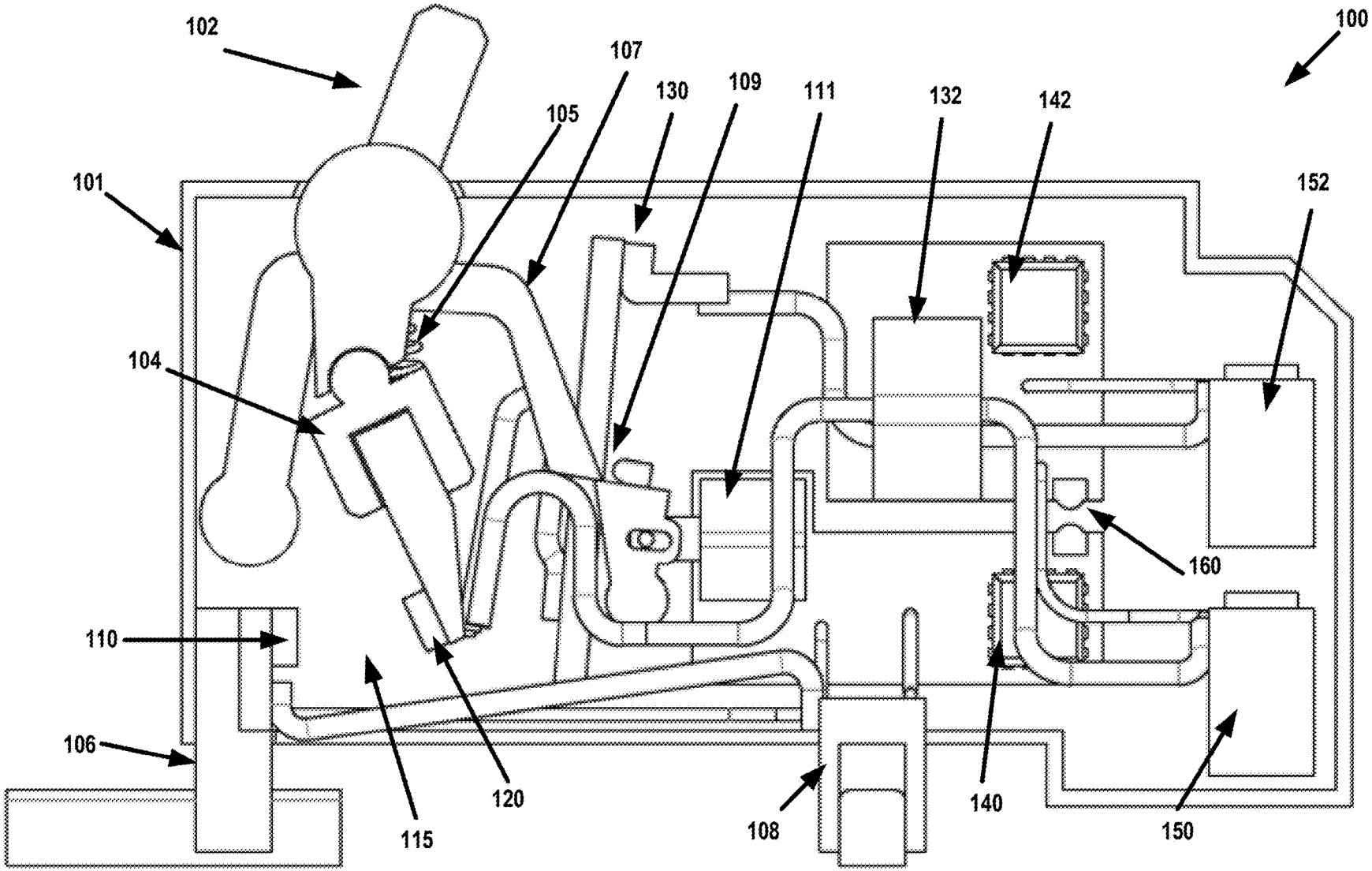
FIG. 4C is a front view of the circuit breaker of FIGS. 3A and 3B, in the contact pairs OPEN or in the OFF position, in accordance with the invention.

FIG. 4C is a front view of the circuit breaker of FIGS. 3A and 3B and FIG. 4B, with the contact pairs OPEN or in the OFF position, in accordance with the invention. The view in FIG. 4C provides a clearer indication of the reduced size arc chamber 115 in the housing and a reduced size air gap between the moveable contact 120 and the stationary contact 110. The reduced size air gaps are based on dividing in half, an arc current flowing between the stationary contacts 110/112 and the moveable contacts 120/122.

Although specific example embodiments of the invention have been disclosed, persons of skill in the art will appreciate that changes may be made to the details described for the specific example embodiments, without departing from the spirit and the scope of the invention.

The invention claimed is:

1. A circuit breaker, comprising:

a first stationary contact connected to a line power terminal of the circuit breaker;

a second stationary contact connected to a neutral terminal of the circuit breaker;

a first moveable contact coupled to a load power terminal of the circuit breaker, the first moveable contact juxtaposed with the first stationary contact to form a power circuit between the line power terminal and the load power terminal when the first moveable and first stationary contacts are closed;

a second moveable contact connected to a load neutral terminal of the circuit breaker, the second moveable contact juxtaposed with the second stationary contact to form a neutral circuit between the neutral terminal and the load neutral terminal when the second moveable and second stationary contacts are closed; and the first and second moveable contacts configured to move in unison to open the power circuit between the first stationary and first moveable contacts and simultaneously to open the neutral circuit between the second stationary and second moveable contacts.

2. The circuit breaker of claim 1, further comprising:

a housing of the circuit breaker, including an operating handle and an overcurrent tripping mechanism; and the movable actuator configured to move the first and second moveable contacts in response to an actuation of the operating handle or to the overcurrent tripping mechanism sensing a tripping event.

3. The circuit breaker of claim 2, further comprising:

a reduced size arc chamber in the housing surrounding the first and second stationary contacts and the first and second moveable contacts, corresponding to a reduced size air gap between the first moveable contact and first stationary contact and a reduced size air gap between the second moveable contact and the second stationary contact, based dividing arc current flow between the first and second stationary contacts and the first and second moveable contacts.

4. The circuit breaker of claim 1, further comprising:

a line powered circuit board including at least one of light emitting diodes (LEDs), denial of service hardware, or communication hardware, directly connected across the line power terminal and the neutral terminal, which remains connected when the first and second stationary contacts and the first and second moveable contacts are opened;

whereby power is provided from the line power side to the circuit board, while preventing an electrical shock hazard if the neutral terminal of the circuit breaker is inadvertently disconnected.

5. The circuit breaker of claim 1, further comprising:

a load-powered circuit board configured to write a fault type of a tripping event, via an opto-coupler, to a line-powered circuit board, at the same time that the first and second stationary contacts and the first and second moveable contacts are opened; and light emitting diodes (LEDs) directly connected across the line power terminal and the neutral terminal, configured to display the type of fault.

* * * * *